US009534594B2

(12) United States Patent
Steinbauer et al.

(10) Patent No.: US 9,534,594 B2
(45) Date of Patent: Jan. 3, 2017

(54) ROTARY PISTON MACHINE, ESPECIALLY ROTARY ENGINE

(71) Applicant: AVL List GmbH, Graz (AT)

(72) Inventors: Michael Steinbauer, Graz (AT); Andreas Krobath, Graz (AT); Karl Knaus, Thal bei Graz (AT); Heinrich Fuerhapter, Graz (AT)

(73) Assignee: AVL List GmbH, Graz (AT)

( * ) Notice: Subject to any disclaimer, the term of this patent is extended or adjusted under 35 U.S.C. 154(b) by 9 days.

(21) Appl. No.: 13/902,700

(22) Filed: May 24, 2013

(65) Prior Publication Data

US 2013/0336829 A1 Dec. 19, 2013

Related U.S. Application Data

(63) Continuation of application No. PCT/EP2011/005925, filed on Nov. 24, 2011.

(30) Foreign Application Priority Data

Nov. 25, 2010 (AT) ..... A 1962/2010
Nov. 25, 2010 (AT) ..... A 1969/2010

(51) Int. Cl.
*F02B 53/00* (2006.01)
*F02B 55/06* (2006.01)
(Continued)

(52) U.S. Cl.
CPC . *F04C 2/00* (2013.01); *F01C 1/22* (2013.01); *F01C 19/02* (2013.01); *F01C 19/12* (2013.01);
(Continued)

(58) Field of Classification Search
CPC ..... F02B 2053/005; F02B 55/06; F01C 19/02; F01C 19/12; F01C 1/22; F04C 2/00
(Continued)

(56) References Cited

U.S. PATENT DOCUMENTS 3,102,682 A * 9/1963 Paschke ..... F02B 55/04 418/61.2
3,112,870 A * 12/1963 Bentele ..... 418/61.2
(Continued)

FOREIGN PATENT DOCUMENTS

DE 23 44 198 A1 3/1975
JP 52089711 A 7/1977
(Continued)

OTHER PUBLICATIONS

International Search Report for PCT/EP2011/005925, Dated April 18, 2012.

(Continued)

*Primary Examiner* — Nicholas J Weiss
*Assistant Examiner* — Wesley Harris
(74) *Attorney, Agent, or Firm* — Knobbe, Martens, Olson & Bear, LLP

(57) ABSTRACT

A rotary piston machine is disclosed. In one aspect, the machine includes a piston chamber that is defined in a housing by a first sidewall, a second sidewall and a peripheral wall interconnecting these sidewalls and a rotary piston that is rotatably arranged in the piston chamber and has a first face and a second face. The first face of the rotary piston faces an interior of the first sidewall of the piston chamber and the second face of the rotary piston faces an interior of the second sidewall of the piston chamber. at least one ventilation bore is provided in the first and/or the second sidewall of the piston chamber and connected to at least one ventilation channel, wherein the at least one ventilation bore is arranged at a location that radially lies within at least one first lateral seal.

15 Claims, 4 Drawing Sheets

(51) Int. Cl.

| | |
|---|---|
| ***F01C 19/02*** | (2006.01) |
| ***F01C 19/12*** | (2006.01) |
| ***F01C 1/22*** | (2006.01) |
| ***F04C 2/00*** | (2006.01) |

(52) U.S. Cl.
CPC ..... *F02B 55/06* (2013.01); *F02B 2053/005* (2013.01)

(58) Field of Classification Search
USPC ..... 418/113, 140–144, 61.1–61.3, 83, 94,418/183–188
See application file for complete search history.

(56) References Cited

U.S. PATENT DOCUMENTS

| | | | | |
|---|---|---|---|---|
| 3,176,915 | A * | 4/1965 | Bentele et al. | 418/61.2 |
| 3,838,951 | A * | 10/1974 | Furuya et al. | 418/84 |
| 3,881,847 | A | 5/1975 | Chen | |
| 3,891,357 | A | 6/1975 | Davis et al. | |
| 6,164,942 | A * | 12/2000 | Moller | 418/86 |
| 2005/0186102 | A1 | 8/2005 | Baier et al. | |
| 2009/0081063 | A1 * | 3/2009 | Kemp | 418/142 |

FOREIGN PATENT DOCUMENTS

| | | | |
|---|---|---|---|
| JP | 2009-228445 | A | 10/2009 |
| WO | WO 2009/101385 | A1 | 8/2009 |

OTHER PUBLICATIONS

Office Action dated Sep. 5, 2014 received in corresponding European Patent Application No. EP2643553.
Japanese Office Action dated Nov. 30, 2015 for Japanese Patent Application No. JP 2013-540266.

* cited by examiner

ROTARY PISTON MACHINE, ESPECIALLY ROTARY ENGINE

CROSS-REFERENCE TO RELATED APPLICATIONS

This application is a continuation application, and claims the benefit under 35 U.S.C. §§120 and 365 of PCT Application No. PCT/EP2011/005925, filed on Nov. 24, 2011, which is hereby incorporated by reference. PCT/EP2011/005922 also claimed priority from Austrian Patent Application Nos. A 1962/2010 and A 1969/2010 both filed on Nov. 25, 2010. All patent documents are incorporated in their entireties.

BACKGROUND

Field

The described technology generally relates to a rotary piston machine and especially a rotary engine.

Description of the Related Technology

Rotary piston machines of this type typically feature a housing, a piston chamber that is defined in the housing by a first sidewall, a second sidewall and a peripheral wall interconnecting these sidewalls and a rotary piston that is rotatably arranged in the piston chamber and has a first face and a second face. In this case, the first face of the rotary piston faces an interior of the first sidewall of the piston chamber and the second face of the rotary piston faces an interior of the second sidewall of the piston chamber. At least two or, in the case of a triangular rotary piston, three working zones are furthermore formed between a peripheral surface of the rotary piston and a peripheral wall of the piston chamber.

In order to prevent so-called blow-by gases from escaping from the working zones into intermediate spaces between the faces of the rotary piston and the sidewalls of the piston chamber during the operation of the rotary piston machine, first lateral seals are provided on the two faces of the rotary piston in order to seal these intermediate spaces relative to the working zones. In order to improve the sealing effect, DE 195 27 396 C2 proposes to elastically pretension the lateral seals, as well as to equip said lateral seals with additional ring seals in the radial direction.

In addition to the aforementioned first lateral seals for sealing the intermediate spaces relative to the working zones, second lateral seals (usually referred to as oil seals) are usually also provided, wherein these second lateral seals are radially positioned within the first lateral seals and serve for sealing the intermediate spaces between the faces of the rotary piston and the sidewalls of the piston chamber relative to the central bore in the rotary piston. Two respective oil seals that are radially spaced apart from one another are frequently provided in order to improve the sealing effect.

Despite the first and second lateral seals provided on the faces of the rotary piston, it cannot always be prevented that blow-by gases escape from the working zones of the piston chamber into the intermediate spaces between the faces of the rotary piston and the sidewalls of the piston chamber.

U.S. Pat. No. 3,849,038 A describes a configuration of a rotary piston machine, in which the intake opening is arranged and shaped in the sidewall of the piston chamber in such a way that a section situated between two radially spaced-apart oil seals, in which blow-by gases can accumulate, passes over this intake opening during the rotation of the rotary piston and the blow-by gases can be discharged from the intermediate space through this intake opening of the piston chamber and returned to the working zones.

According to U.S. Pat. No. 4,080,118 A, recesses are respectively provided in the faces of the rotary piston radially between the first lateral seals and the second lateral seals, wherein the blow-by gases that escape from the working zones through the first lateral seals can accumulate in said recesses. In this embodiment, the blow-by gases are also discharged through the intake opening in the sidewall(s) of the piston chamber while the rotating rotary piston passes over this intake opening.

JP 03-037301 A discloses a rotary piston machine, in which recesses are respectively provided in the faces of the rotary piston radially between the first lateral seals and the second lateral seals thereof and the blow-by gases from the working zones can accumulate in said recesses. The rotary piston is furthermore realized with an axial through-bore that interconnects the recesses in the two faces of the rotary piston. This through-bore makes it possible to realize a pressure reduction of the blow-by gases, as well as a pressure compensation between the blow-by gases to both faces of the rotary piston.

In the rotary piston machine according to WO 2009/101385 A1, the blow-by gases escaping from the working zones through the lateral seals of the rotary piston are utilized for regulating the pressure of a cooling gas flowing through the rotary piston.

SUMMARY

One inventive aspect is a rotary engine, in which an essentially triangular rotary piston revolves on an eccentric shaft arranged in a crankcase.

Another aspect is rotary engines with two, four or more piston corners and, in principle, may also be used in rotary piston machines with a rotary piston that centrally revolves in the crankcase.

Another aspect is rotary piston machines including two, three or more adjacently arranged rotary pistons.

One embodiment may be suitable for use in motor vehicles. Some embodiments can be utilized in a particularly advantageous fashion in conjunction with a power generating unit, in particular, in the form of a so-called range extender in electrically operated motor vehicles.

Another aspect is a rotary piston machine including a housing, a piston chamber that is defined in the housing by a first sidewall, a second sidewall and a peripheral wall interconnecting these sidewalls, a rotary piston that is rotatably arranged in the piston chamber and has a first face and a second face, wherein the first face of the rotary piston faces an interior of the first sidewall of the piston chamber and the second face of the rotary piston faces an interior of the second sidewall of the piston chamber, and wherein at least two working zones are formed between a peripheral surface of the rotary piston and the peripheral wall of the piston chamber, and at least one first lateral seal on the first and the second face of the rotary piston in order to seal the respective intermediate spaces between the first and the second sidewall of the piston chamber and the first and the second face of the rotary piston relative to the working zones. According to the invention, the rotary piston machine is characterized in that at least one ventilation bore is provided in the first and/or the second sidewall of the piston chamber and connected to at least one ventilation channel in the housing, wherein the at least one ventilation bore is arranged at a location that radially lies within the at least one first lateral seal.

The rotary piston machine may be realized, in particular, in the form of a rotary engine. In addition, the rotary piston machine or the rotary engine may be realized, in particular, in the form of a so-called Range Extender for an electrically operated motor vehicle.

At least one ventilation bore may be connected to at least one ventilation channel in the housing and provided at a location in the first and/or the second sidewall of the piston chamber that radially lies within the at least one first lateral seal, blow-by gases that escape from the working zones through the first lateral seals can be very rapidly discharged from the intermediate spaces between the sidewalls of the piston chamber and the faces of the rotary piston. This rapid discharge of the blow-by gases also makes it possible to very rapidly and reliably reduce the pressures or pressure loads caused by the blow-by gases.

The first lateral seals on the faces of the rotary piston may prevent the escape of blow-by gases from the working zones in the piston chamber into the intermediate spaces between the sidewalls of the piston chamber and the faces of the rotary piston. However, this sealing effect cannot always be ensured in its entirety, in particular, at high pressures in the working zones. Since the highest pressures are generated at the time of the ignition in the working zones, the escape of blow-by gases into the intermediate spaces between the sidewalls of the piston chamber and the faces of the rotary piston also takes place, in particular, at that time.

The at least one ventilation bore may be arranged at a location that radially lies within the at least one first lateral seal of the rotary piston. In this way, blow-by gases can only be discharged from said intermediate spaces, but not directly from the working zones, through the at least one ventilation bore in the sidewall(s) of the piston chamber.

The term "piston chamber" generally refers to a chamber in the housing of the rotary piston machine, in which the rotary piston is arranged. The driveshaft of the rotary piston machine, on which the rotary piston revolves, usually also extends through this piston chamber. The piston chamber is axially defined by a first and a second sidewall and radially defined by a peripheral wall. The "sidewalls" and/or the "peripheral wall" of the piston chamber may be realized integrally with the housing or a housing part or in the form of separate components that may be rigidly connected to the housing or a housing part. The respective walls of the piston chamber may be selectively manufactured of the same material as the housing or of a material that differs from the material of the housing.

The term "working zones" refers to the subzones of the piston chamber that are formed between the rotary piston and the peripheral wall of the piston chamber. Three such working zones are provided, for example, in the case of a triangular rotary piston. The at least two working zones are usually separated from one another, for example, by means of radial seals in the corners of the rotary piston.

The "at least one first lateral seal" may consist of a sealing means that is respectively arranged in or on the first and the second face of the rotary piston. The at least one first lateral seal also abuts on the respective inner side of the first and the second sidewall of the piston chamber during the rotation of the rotary piston, wherein the lateral seal may be for this purpose pretensioned, particularly pretensioned elastically, in the direction toward the respective sidewall of the piston chamber. The first lateral seal consists of a one-part or multipart component. The "at least one" first lateral seal comprises exactly one first lateral seal, as well as two or more first lateral seals that are radially spaced apart from one another. The first lateral seals are typically arranged on the first face and on the second face of the rotary piston. This arrangement of the first lateral seals may either be realized symmetrically or asymmetrically with respect to the positioning, the size, the shape, the design and/or the number of the first lateral seals.

The "at least one ventilation bore" generally refers to a through-bore in the respective sidewall of the piston chamber, through which blow-by gases can flow. Exactly one ventilation bore or two or more ventilation bores that are radially and/or axially spaced apart from one another may be provided in a sidewall of the piston chamber. In addition, the ventilation bore(s) may either be provided in only one of the two sidewalls of the piston chamber or in both sidewalls of the piston chamber. In the latter instance, the ventilation bores in the sidewalls are either connected to a common ventilation channel in the housing or two different ventilation channels in the housing.

The terms "radially" and "axially" respectively refer to the rotational axis of the driveshaft of the rotary piston machine, about which the rotary piston revolves. Consequently, "axially" refers to a direction that essentially extends parallel to the rotational axis of the driveshaft and "radially" refers to a direction that essentially extends perpendicular to the rotational axis of the driveshaft.

The arrangement of the at least one ventilation bore radially "within the at least one first lateral seal" refers to the at least one ventilation bore, for example, all ventilation bores in the sidewall of the piston chamber, being positioned radially within the one first lateral seal (if exactly one first lateral seal is provided) or within the radially outermost first lateral seal, for example, within the radially innermost first lateral seal (if two or more first lateral seals are provided on a face of the rotary piston). The ventilation bore(s) is/are essentially arranged entirely within the at least one first lateral seal. Furthermore, the at least one ventilation bore may be arranged within an envelope (over one complete revolution of the rotary piston), for example, within an inner envelope, of the at least one first lateral seal.

In some embodiments, the rotary piston also includes a central bore and at least one second lateral seal is provided on the first and the second face of the rotary piston in order to seal the respective intermediate spaces between the first and the second sidewall of the piston chamber and the first and the second face of the rotary piston relative to the central bore, wherein the at least one second lateral seal is radially arranged within the at least one first lateral seal. In this case, the at least one ventilation bore is radially positioned outside the at least one second lateral seal.

The second lateral seals basically serve for sealing the respective intermediate spaces between the first and the second sidewall of the piston chamber and the first and the second face of the rotary piston relative to the central bore in order to prevent the escape of a lubricant (e.g. lubricating oil) for the bearings of the driveshaft and of the rotary piston from the central bore into the aforementioned intermediate spaces. In addition, these second lateral seals improve the sealing effect against the escape of blow-by gases from the working zones of the piston chamber into the aforementioned intermediate spaces and into the central bore of the rotary piston.

The arrangement of the at least one ventilation bore radially outside the at least one second lateral seal may cause the at least one ventilation bore to be radially positioned between the at least one first lateral seal and the at least one second lateral seal in this embodiment.

The "at least one second lateral seal" may consist of a sealing means that is respectively arranged in or on the first and the second face of the rotary piston. The at least one second lateral seal also abuts on the respective inner side of the first and the second sidewall of the piston chamber during the rotation of the rotary piston, wherein the lateral seal may be for this purpose pretensioned, particularly pretensioned elastically, in the direction toward the respective sidewall of the piston chamber. The second lateral seal consists of a one-part or multipart component. The "at least one" second lateral seal comprises exactly one second lateral seal, as well as two or more second lateral seals that are radially spaced apart from one another. The second lateral seals are typically arranged on the first face and the second face of the rotary piston. This arrangement of the second lateral seals may either be realized symmetrically or asymmetrically with respect to the positioning, the size, the shape, the design and/or the number of the second lateral seals. The first and the second lateral seals may either be realized essentially identical or different from one another.

The arrangement of the at least one ventilation bore radially "outside the at least one second lateral seal" refers to the at least one ventilation bore, for example, all ventilation bores in the sidewall(s) of the piston chamber, being positioned radially outside the second lateral seal (if exactly one second lateral seal is provided) or outside the radially innermost second lateral seal, outside the radially outermost second lateral seal (if two or more second lateral seals are provided on a face of the rotary piston). The ventilation bore(s) is/are essentially arranged entirely outside the at least one second lateral seal. Furthermore, the at least one ventilation bore may be arranged outside an envelope (over one complete revolution of the rotary piston), for example, outside an outer envelope, of the at least one second lateral seal.

In some embodiments, at least one radial seal that protrudes in the direction toward the peripheral wall of the piston chamber is arranged on the peripheral surface of the rotary piston. In this case, the at least one ventilation bore may lie radially within the at least one radial seal.

The "at least one radial seal" may consist of a sealing means that is arranged in or on the peripheral surface of the rotary piston and serves for separating the adjacent working zones during the revolution of the rotary piston. The at least one radial seal also abuts on the peripheral wall of the piston chamber during the rotation of the rotary piston. The radial seals may be provided in the corner regions of the rotary piston, wherein the "at least one" radial seal comprises exactly one, two or more radial seals in each corner region of the rotary piston. The respective radial seals may be arranged in a sealing bolt in the rotary piston, particularly inserted into a groove of a sealing bolt in the rotary piston.

The arrangement of the at least one ventilation bore radially "within the at least one radial seal" refers to the at least one ventilation bore, for example, all ventilation bores in the sidewall(s) of the piston chamber, being positioned radially within the radially inner edges of the radial seals, particularly within the bottoms of the grooves for the radial seals in the sealing bolt. The ventilation bore(s) may be essentially arranged entirely within the at least one radial seal or its groove bottom. Furthermore, the at least one ventilation bore may be positioned within an envelope, particularly within an inner envelope, of the at least one radial seal or its groove bottom.

The positioning of the at least one ventilation bore radially within the at least one radial seal consequently refers to the at least one ventilation bore lying radially within the at least one first lateral seal or within the at least one radial seal depending on which position lies farther radially inward.

In some embodiments, the at least one ventilation bore lies within an angular segment, in which no cooling medium bore is provided in the first and the second sidewall. This measure makes it possible to prevent the cooling medium bores and the ventilation bores from interfering with one another in the respective sidewall of the piston chamber. In other words, the at least one ventilation bore is positioned in an angular segment, in which sufficient space is available for its arrangement.

In some embodiments, the at least one ventilation bore lies within an angular segment of the cold arc of the piston chamber. This "cold arc" refers to the angular segment of the piston chamber, in which a consistently cold zone forms in the essentially stationary temperature distribution. This measure also makes it possible to prevent the ventilation bores and any cooling measures of the rotary piston machine from interfering with one another.

In some embodiments, the rotary piston features at least one cavity that radially extends from the first face to the second face within the at least one first lateral seal or between the at least one first lateral seal and the at least one second lateral seal. This cavity interconnects the intermediate spaces to both faces of the rotary piston such that the blow-by gases escaping into the respective intermediate spaces between the first and the second sidewall of the piston chamber and the first and the second face of the rotary piston can flow into the cavity of the rotary piston. In this way, the pressure built up in the aforementioned intermediate spaces due to the blow-by gases can be reduced and compensated between the two faces of the rotary piston.

The "at least one" cavity extending in the rotary piston between the two faces thereof comprises exactly one cavity, as well as two or more cavities. The "cavity" generally consists of an arbitrary cavity, through which the blow-by gases can flow. The "at least one cavity" may essentially extend through the rotary piston axially; however, it may also be aligned at an angle referred to this axial direction. In addition, the at least one cavity may essentially be realized straight or curved or sectionally curved. Furthermore, the at least one cavity may have an essentially constant cross section (with respect to its shape and/or size) or a variable cross section over its length.

In the above-described rotary piston with at least one cavity, at least one ventilation bore may be only provided in the first or in the second sidewall of the piston chamber. Due to this measure, it also suffices to provide a ventilation channel in the housing on only one side of the rotary piston. Consequently, a compact design of the entire rotary piston machine can be achieved. However, the scope of the invention basically also includes constructions, in which at least one ventilation bore is respectively provided on both sidewalls of the piston chamber.

In some embodiments, the rotary piston features in the region of each working zone at least one first recess in the first face radially within the at least one first lateral seal or between the at least one first lateral seal and the at least one second lateral seal and at least one second recess in the second face radially within the at least one first lateral seal or between the at least one first lateral seal and the at least one second lateral seal. In this way, the blow-by gases escaping into the respective intermediate spaces between the first and the second sidewall of the piston chamber and the first and the second face of the rotary piston can be accommodated in the recesses and the pressure built up in the aforementioned intermediate spaces due to the blow-by gases can be reduced.

In some embodiments, the at least one first recess in the first face of the rotary piston and the at least one second recess in the second face of the rotary piston may be interconnected by means of at least one through-opening. In this way, the pressure generated in the aforementioned intermediate spaces and in the recesses of the rotary piston faces due to the blow-by gases can be compensated between the two faces of the rotary piston. In this case, a continuous cavity with the above-described advantages is also created in the rotary piston by means of this/these through-opening(s).

The "at least one" first or second recess in the first/second face of the rotary piston may comprise exactly one first or second recess, as well as two, three or more first or second recesses. This arrangement of the first and the second recesses may either be realized symmetrically or asymmetrically with respect to the positioning, the size, the shape, the design and/or the number of the first/second recesses.

The "at least one" through-opening in the rotary piston extending between the recesses to both faces of the rotary piston may comprise exactly one through-opening, as well as two or more through-openings. Several recesses may be connected by means of one through-opening and several through-openings may interconnect a first recess and a second recess.

The "through-opening" generally consists of an arbitrary through-opening, through which the blow-by gases can flow. The "at least one through-opening" may essentially extend through the rotary piston axially between the recesses; however, it may also be aligned at an angle referred to this axial direction. In addition, the at least one through-opening may essentially be realized straight or curved or sectionally curved. Furthermore, the at least one through-opening may have an essentially constant cross section (with respect to its shape and/or size) or a variable cross section over its length.

In some embodiments, the at least one ventilation bore is connected to the ventilation channel by means of at least one connecting channel. The connecting channel in the housing makes it possible to position the ventilation channel more or less independently of the position of the ventilation bore in the sidewall of the piston chamber.

In some embodiments, the at least one ventilation bore and/or the at least one connecting channel is/are realized in an at least partially ascending fashion in the direction toward the ventilation channel (during the operation of the rotary piston machine). This alignment of the ventilation bore and/or the connecting channel improves the discharge of the blow-by gases from the respective intermediate spaces between the sidewalls of the piston chamber and the faces of the rotary piston into the ventilation channel. Furthermore, this alignment of the ventilation bore and/or the connecting channel makes it possible to achieve a more or less pronounced oil separation effect such that less lubricant is entrained into the ventilation channel by the blow-by gases.

In some embodiments, at least one device for influencing the respective opening cross section of the ventilation bore or of the connecting channel is provided in or on the at least one ventilation bore and/or the at least one connecting channel. This device for influencing the opening cross section may be realized, for example, in the form of a throttle or a diaphragm. Due to this measure, a pressure difference can be advantageously adjusted between the ventilation channel on the one hand and the respective intermediate spaces between the sidewalls of the piston chamber and the faces of the rotary piston or the recesses or cavities in the rotary piston on the other hand.

The at least one ventilation bore may have an elongate cross section in the concentric direction of the rotary piston, particularly an essentially reniform cross section. This design of the ventilation bore(s) improves the discharge of the blow-by gases from the respective intermediate spaces between the sidewalls of the piston chamber and the faces of the rotary piston into the ventilation channel.

In some embodiments, the at least one ventilation channel is connected to an oil separating device in the housing. In some embodiments, the at least one ventilation channel is connected to an oilpan.

In some embodiments, at least one additional connecting channel is provided in order to connect the central bore of the rotary piston to the ventilation channel. The blow-by gases escaping through not only the first lateral seals, but also the second lateral seals, can also be discharged from the central bore of the rotary piston through this additional connecting channel.

Furthermore, the ventilation channel, the connecting channel and/or the additional connecting channel may be at least partially realized in a labyrinth-like fashion and/or feature at least one plenum chamber. These measures improve the oil separation from the blow-by gases and therefore allow a more compact design of the rotary piston machine.

Some embodiments can be utilized in a particularly advantageous fashion in a power generating unit, especially for an electrically operated motor vehicle, wherein a rotatably supported driveshaft, on which the rotary piston revolves, is provided in the housing and coupled to an electromechanical energy converter in this case.

DETAILED DESCRIPTION

Figure 1:
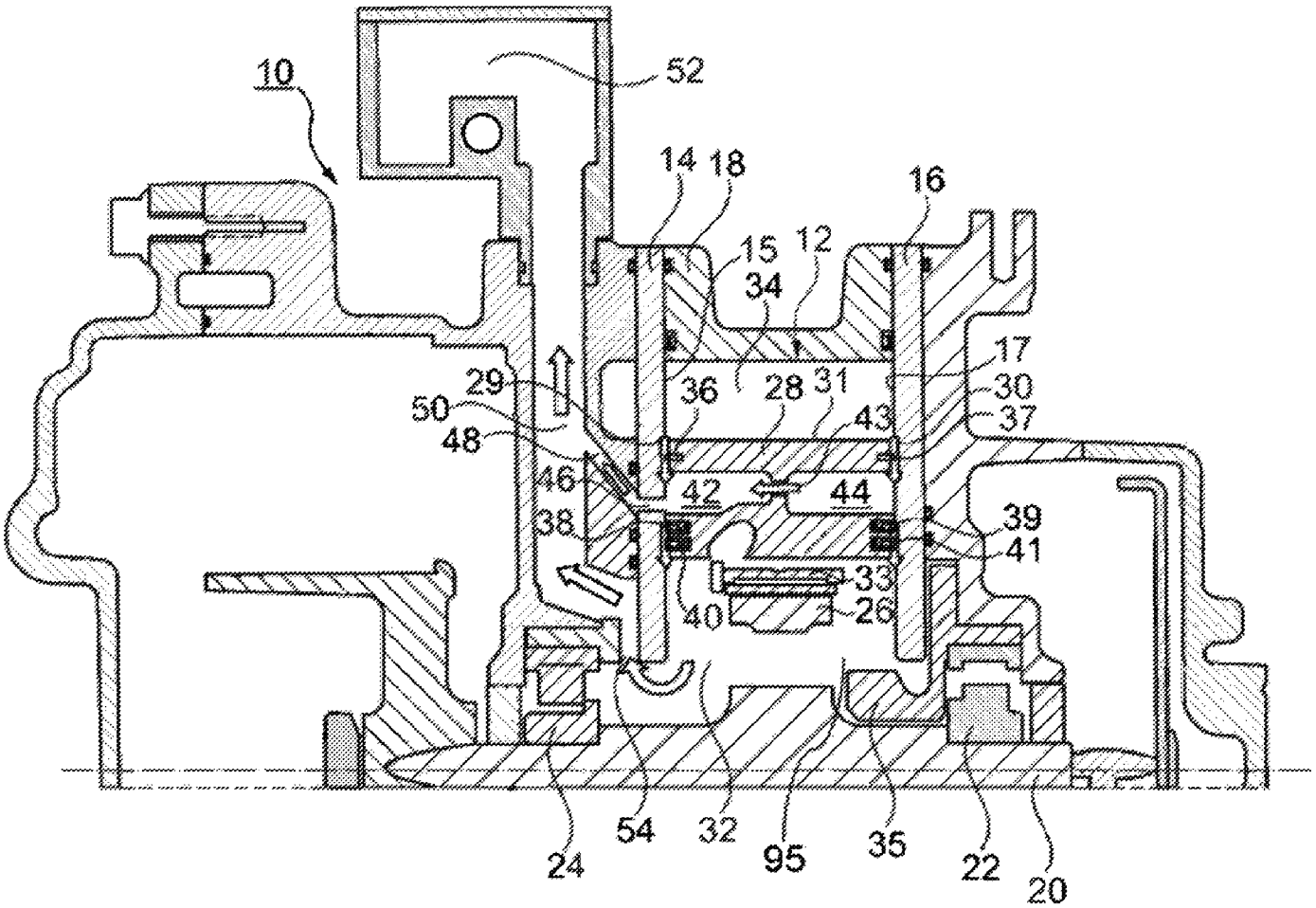
FIG. 1 shows a longitudinal section through a detail of a rotary piston machine.

Embodiments will be described with reference to the accompanying drawings.

One embodiment uses the example of a rotary engine with an essentially triangular rotary piston in this case. A piston chamber 12 is arranged in a housing 10 of the rotary piston machine, wherein said piston chamber is defined by a first sidewall 14 and a second sidewall 16 that are axially (right/left direction in FIG. 1) spaced apart from one another and essentially aligned parallel to one another, as well as a peripheral wall 18 that axially interconnects these sidewalls 14 and 16. The peripheral wall 18 of the piston chamber 12 has a trochoid-shaped inner running surface. In this exemplary embodiment, the walls 14, 16, 18 of the piston chamber 12 are realized in the form of components that are manufactured separately of the remaining machine housing 10.

The driveshaft 20 is rotatably supported in the housing by means of bearing devices 22, 24. In a rotary engine, this driveshaft 20 has an eccentric section 26.

This eccentric shaft 20 is coupled to a (not-shown) electromechanical energy converter in order to form a power generating unit. The electromechanical energy converter may consist, for example, of a generator that converts the mechanical energy of rotation of the eccentric shaft 20 into electrical energy during the operation of the rotary piston machine in order to subsequently store this electrical energy, for example, in a (not-shown) electrochemical energy storage device such as, for example, a battery, an accumulator or the like.

The energy stored in the energy storage device can then be used for operating, for example, an electric motor that drives at least one wheel of a motor vehicle. In this case, the power generating unit with the rotary engine and the generator serves as a so-called Range Extender that, if so required, recharges the battery of the electrically operated motor vehicle and thusly extends the range of the motor vehicle.

According to FIG. 1, a rotary piston 28 arranged in the piston chamber 12 is seated on the eccentric section 26 and revolves about the driveshaft 20, wherein a bearing device 33, for example, in the form of a needle bearing is provided between the eccentric section 26 of the driveshaft 20 and the rotary piston 28.

In some embodiments, the rotary piston 28 is essentially realized with a triangular shape such that three working zones 34 are formed between its peripheral surface 31 and the peripheral wall 18 of the piston chamber 12. The four cycles of a rotary engine conventionally take place in these three working chambers 34 in order to turn the rotary piston.

The rotary piston 28 has a first face 29 (on the left in FIG. 1) that faces an interior 15 of the first sidewall 14 of the piston chamber 12 and a second face 30 (on the right in FIG. 1) that faces an interior 17 of the second sidewall 16 of the piston chamber 12. The rotary piston 28 furthermore features a central bore 32, through which the driveshaft 20 extends. This central bore 32 of the rotary piston 28 is realized with an internal gear that is engaged with a gearwheel 35 arranged on the housing 10 in a rotationally rigid fashion coaxial to the eccentric shaft 20. The movement of the rotary piston 28 in the housing 10 is controlled with the gearwheel 35.

The central bore 32 of the rotary piston 28 forms a volume that is connected to an oil circuit and supplied with lubricating oil by means of an oil pump during the operation of the rotary engine. This lubricating oil serves for lubricating the bearing points 22, 24, 26 of the eccentric shaft 20 in the housing 10 and of the rotary piston 28 on the eccentric shaft 20.

Radial seals 58 are provided in the three corners of the rotary piston 28 in order to seal the three working zones 34 relative to one another. According to FIG. 2, these radial seals 58 are essentially realized in a strip-shaped fashion and fixed in correspondingly shaped grooves 57 in sealing bolts 56. The sealing bolts 56 respectively extend axially through the rotary piston 28 in a corner region thereof. In addition, they may be contacted by the adjacent first lateral seals 36, 37 on the first and the second face 29, 30 of the rotary piston 28.

In addition, several seals 36-41 are provided in the respective intermediate spaces between the sidewalls 14, 16 of the piston chamber 12 and the faces 29, 30 of the rotary piston 28 in order to seal these intermediate spaces with respect to blow-by gases escaping from the working zones 34 on the one hand and with respect to the admission of lubricating oil from the central bore 32 of the rotary piston 28 on the other hand.

In more precise terms, a first lateral seal 36 is arranged on the first face 29 of the rotary piston 28 in order to seal the intermediate space relative to the working zones 34 and a first lateral seal 37 is arranged on the second face 30 of the rotary piston 28 in order to seal the intermediate space relative to the working zones 34. Both of these first lateral seals 36, 37 may be elastically prestressed relative to the respective sidewall 14, 16 of the piston chamber 12.

Furthermore, two radially spaced-apart second lateral seals 38, 40 are arranged on the first face 29 of the rotary piston 28 in order to seal the intermediate space relative to the central bore 32 and two radially spaced-apart second lateral seals 39, 41 are arranged on the second face 30 of the rotary piston 28 in order to seal the intermediate space relative to the central bore 32. These second lateral seals 38, 39, 40, 41 may be also elastically prestressed relative to the respective sidewall 14, 16 of the piston chamber 12. The second lateral seals 38, 40 and 39, 41 are arranged in pairs and also referred to as oil seals or scraper rings.

According to FIG. 1, a first recess 42 is provided in the first face 29 of the rotary piston 28 radially between the first lateral seal 36 and the radially outermost second lateral seal 38. A second recess 44 is analogously provided in the second face 30 of the rotary piston 28 radially between the first lateral seal 37 and the radially outermost second lateral seal 39. These two recesses 42, 44 in the faces 29, 30 of the rotary piston 28 are also interconnected by means of a through-opening 43.

Instead of the construction according to FIG. 1 that features two recesses 42, 44 in the two faces 29, 30 and a through-opening 43 extending between said recesses, the rotary piston 28 may also be realized with a continuous cavity that directly interconnects the two faces 29, 30 of the rotary piston 28 radially between the first and the second lateral seals 36, 37 and 38, 39.

If blow-by gases escape from the working zones 34 of the piston chamber 12 into the intermediate spaces between the sidewalls 14, 16 of the piston chamber 12 and the faces 29, 30 of the rotary piston during the operation of the rotary piston machine despite the first lateral seals 36, 37, these blow-by gases can be accommodated in the recesses 42, 44. The pressure generated in the intermediate spaces due to the blow-by gases is reduced or lowered due to the volume of the recesses 42, 44. In addition, a pressure compensation between the first face 29 and the second face 30 of the rotary piston 28 is achieved due to the through-opening 43 extending between the two recesses 42, 44.

FIG. 1 also shows a ventilation bore 46 in the first sidewall 14 of the piston chamber 12. This ventilation bore 46 is arranged at a location that radially lies between the first lateral seal 36 and the radially outer second lateral seal 38 at the time of ignition. In this way, blow-by gases that escape into the intermediate spaces through the first lateral seals 36, 37 on the rotary piston 28 due to the high pressure in the respective working zones 34 after the ignition can be discharged through the ventilation bore 46 in the first sidewall 14.

In more precise terms, the ventilation bore 46 is positioned on the second face 30 of the rotary piston 28 radially within an inner envelope of the first lateral seal 37 (over one complete revolution of the rotary piston 28) and outside an outer envelope of the radially outer second lateral seal 39. In addition, the ventilation bore 46 is also positioned radially within an inner envelope of the groove bottoms 57 for the radial seals 58 in the sealing bolts 56.

The described choice of the position of the ventilation bore 46 in the first sidewall 14 of the piston chamber 12 makes it possible to ensure that this ventilation bore 46 is connected to the section of the intermediate space between the face 29 of the rotary piston 28 and the sidewall 14, in which blow-by gases can accumulate, in all operating positions of the rotary piston 28 and that a direct fluidic connection with one of the working zones 34 is never produced.

Although not illustrated in the figures, several cooling medium bores are arranged in the sidewalls 14 and 16 of the piston chamber in the region of the so-called hot arc in order to cool the rotary piston machine. This is the reason why the ventilation bore 46 may be positioned in the angular segment of the so-called cold arc of the piston chamber 12, in which no cooling medium bores are arranged in the sidewalls 14, 16.

Figure 2:
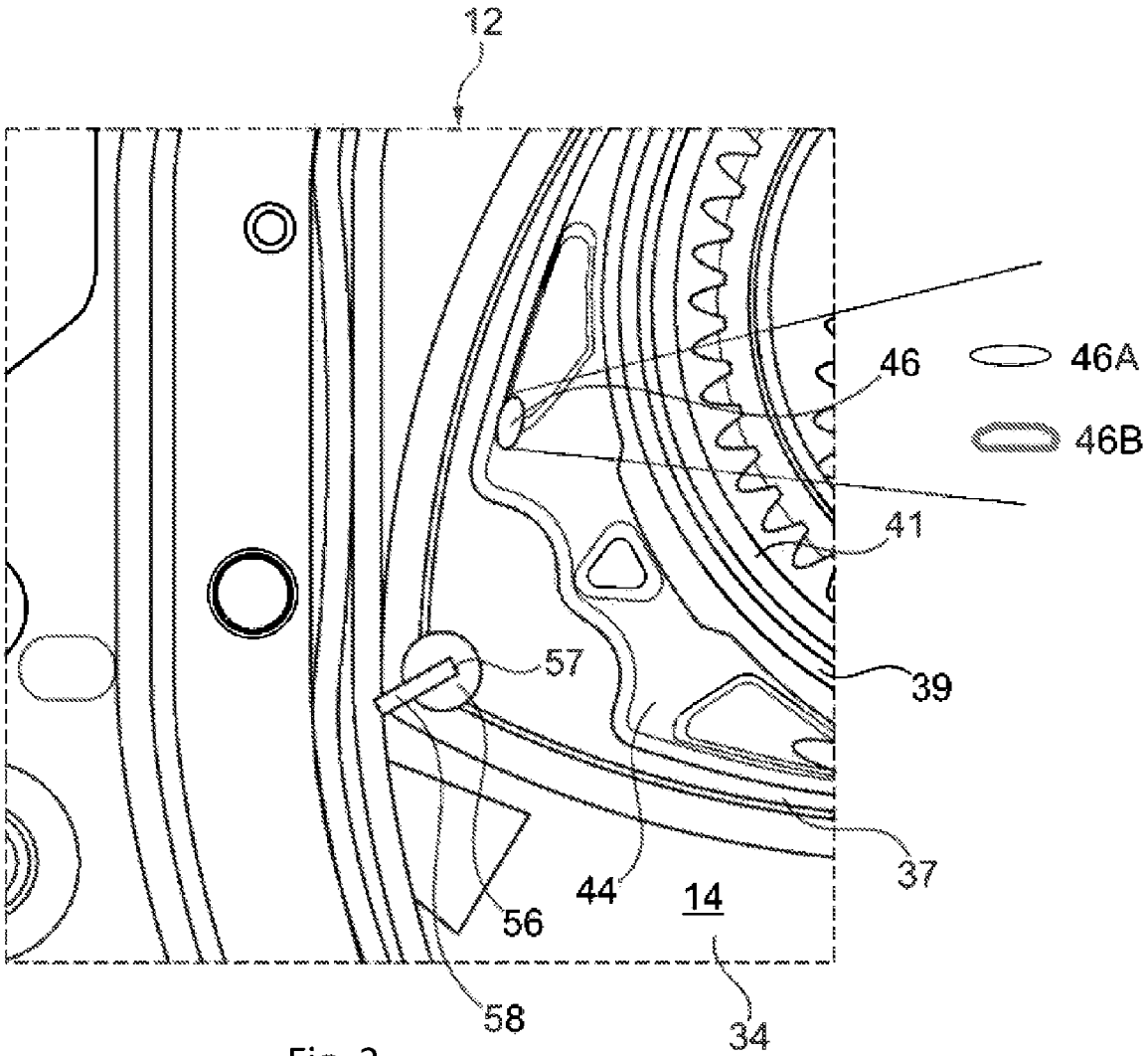
FIG. 2 shows a cross section through a detail of the rotary piston machine in FIG. 1.

The ventilation bore 46 may have an essentially elongate cross section 46A as or reniform cross section 46B, as illustrated in FIG. 2, in the concentric direction in order to improve the efficiency of discharging the blow-by gases through the ventilation bore.

A connecting channel 48 connects the ventilation bore 46 in the first sidewall 14 to a ventilation channel 50 in the housing 10, through which the blow-by gases can be discharged from the housing 10. In this case, the ventilation channel 50 is connected to an oil separating device 52 in order to achieve a largely complete separation of lubricating oils entrained by the blow-by gases. The separated oils are fed to an oilpan (not shown) that is connected to the lubricating oil circuit of the rotary piston machine via a (not-shown) drainage channel. Since the separated lubricating oil is returned into the oil pan, this lubricating oil is once again available to the lubricating oil circuit. Consequently, the quantity of lubricating oil required for the operation of the rotary piston machine can be minimized.

Figure 3:
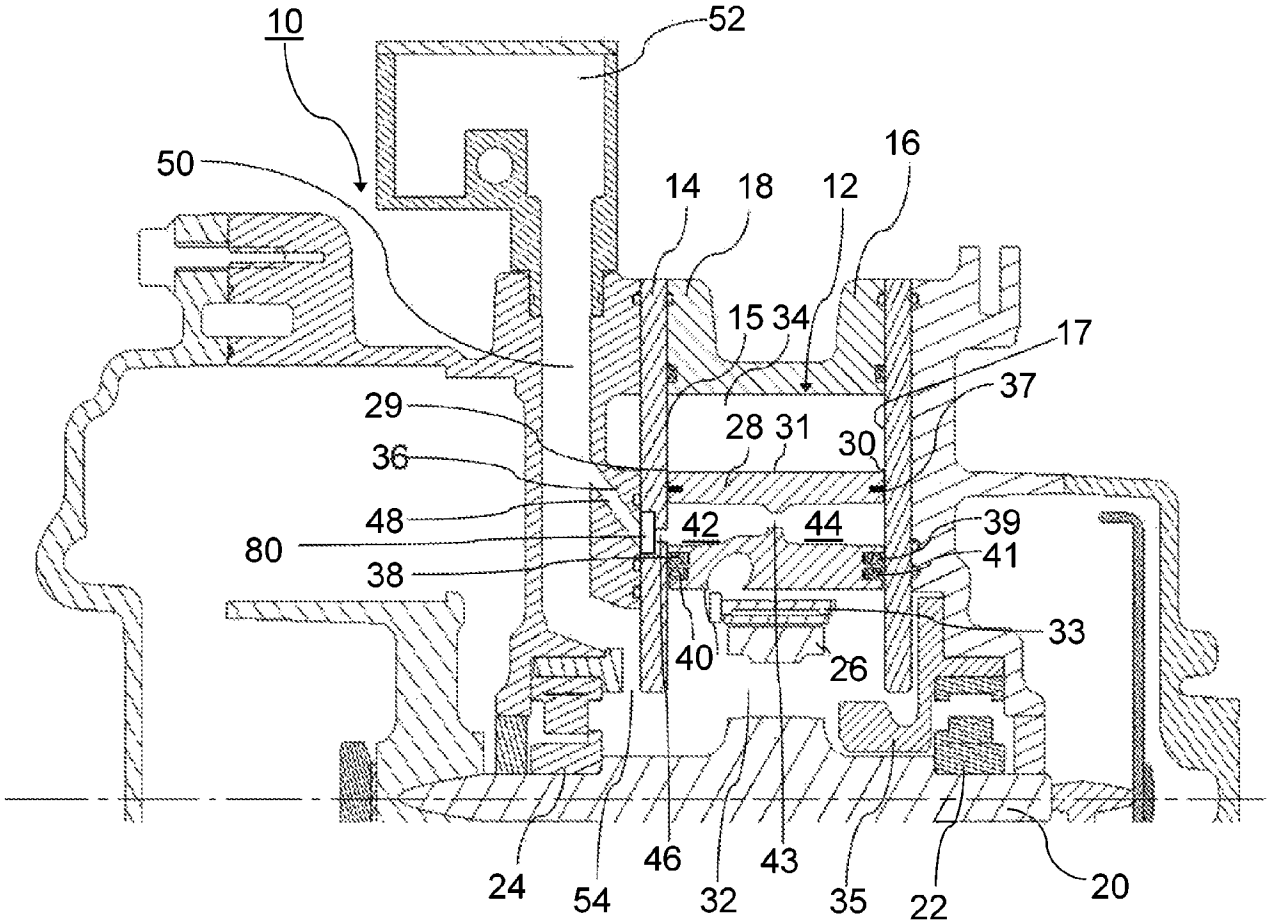
FIG. 3 shows the longitudinal section of FIG. 1, with a ventilation bore equipped with a device configured to purposefully influence the cross section of a flow channel.
Figure 4:
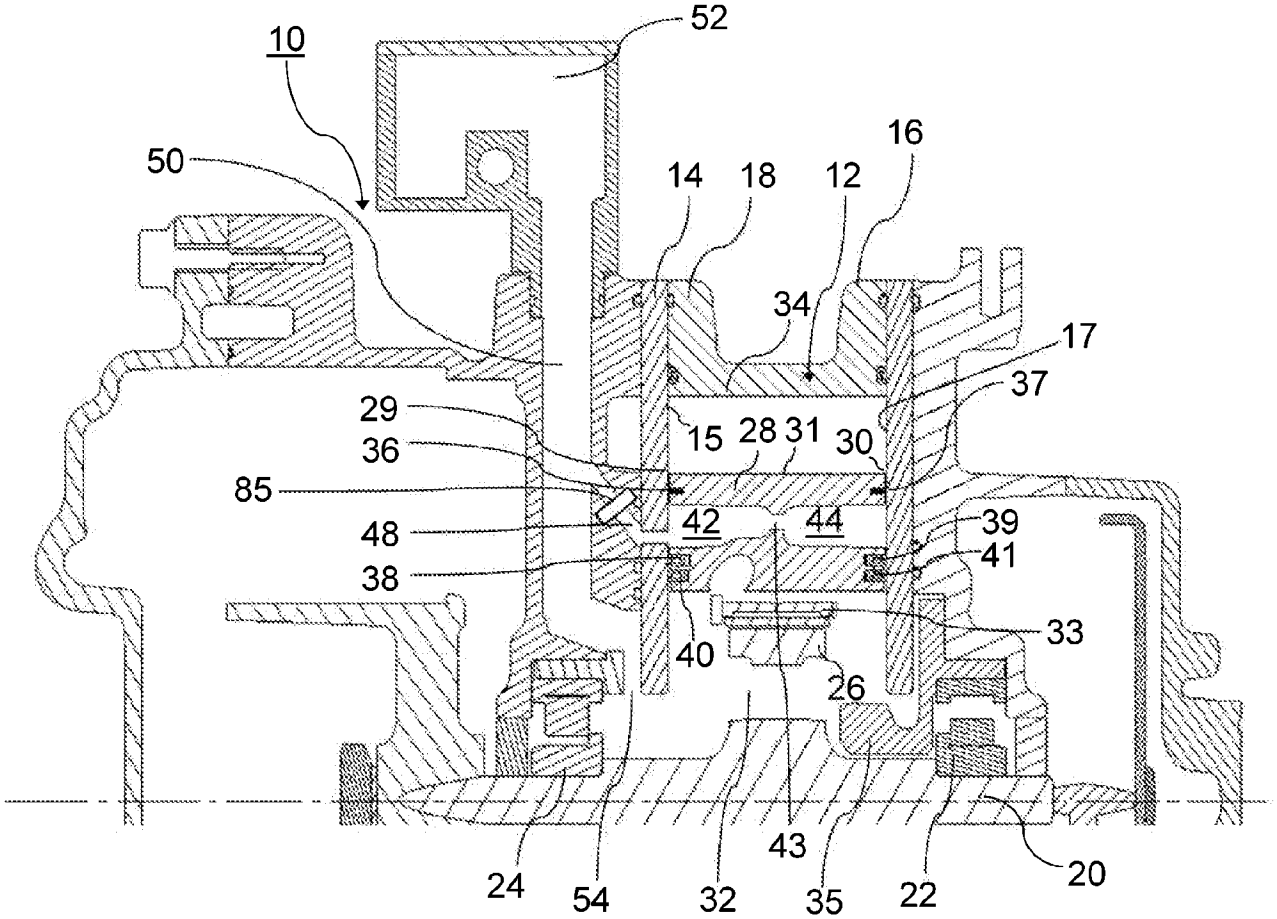
FIG. 4 shows the longitudinal section of FIG. 1, with a connecting channel equipped with a device configured to purposefully influence the cross section of a flow channel.

According to FIG. 1, the connecting channel 48 between the ventilation bore 46 in the first sidewall 14 of the piston chamber 12 and the ventilation channel 50 in the housing 10 is realized in an ascending fashion in the flow direction of the blow-by gases. The ventilation bore 46 itself may be alternatively or additionally provided with such an ascent. The ventilation bore 46 may furthermore be equipped with a throttle or diaphragm, (device 80 shown in FIG. 3) in order to purposefully influence the cross section of the flow channel. The connecting channel 48 may furthermore be equipped with a throttle or diaphragm, (device 85 shown in FIG. 4) in order to purposefully influence the cross section of the flow channel. Due to the above-described measures, lubricating oils or the like entrained by the blow-by gases already can be more or less separated at these locations.

Furthermore, the central bore 32 of the rotary piston 28 is also connected to the ventilation channel 50 in the housing 10 by means of an additional connecting channel 54. In this way, the usually relatively small quantities of blow-by gases that escape into the central bore 32 of the rotary piston 28 through the second lateral seals 38-41 between the faces 29, 30 of the rotary piston 28 and the sidewalls 14, 16 of the piston chamber 12 can also be discharged. This additional connecting channel 54 is also realized in an ascending fashion in the flow direction of the blow-by gases. This makes it possible to increase the separation rate of the lubricating oil from the blow-by gases originating from the central bore 32.

Although not illustrated in the figures, the ventilation channel 50, the connecting channel 48 and/or the additional connecting channel 54 feature labyrinth-like sections and/or at least one plenum chamber 95. These measures already improve the oil separation from the blow-by gases in the housing 10 and respectively make it possible to achieve a more compact design of the rotary piston machine and to provide a smaller oil separating device 52 on the downstream end of the ventilation channel 50.

The compact design of the embodiment of the rotary engine illustrated in FIG. 1 contains only one common ventilation channel 50 on the side of the first sidewall 14 of the piston chamber 12 in the housing 10. However, it is basically also possible to provide ventilation channels 50 to both sides of the piston chamber 12 such that the blow-by gases can be discharged on both faces 29, 30 of the rotary piston 28.

The cross-sectional shapes and sizes of the connecting channels 48, 54 leading to the ventilation channel 50 make it possible to adjust pressure differences between the recesses 42, 44, the central bore 32 and the ventilation channel 50 in the desired fashion.

At least one of the disclosed embodiments provides a rotary piston machine with improved ventilation of blow-by gases that escape from the working zones in the piston chamber into the intermediate spaces between the sidewalls of the piston chamber and the faces of the rotary piston.

While the above embodiment have been described with reference to the accompanying drawings, they are for illustrative purposes only and do not limit the invention. It is to be appreciated that those skilled in the art can change or modify the embodiments without departing from the scope and spirit of the invention.

What is claimed is:

1. A rotary piston machine, comprising:

a housing;

a piston chamber that is defined in the housing by a first sidewall, a second sidewall and a peripheral wall interconnecting the first and second sidewalls;

a rotary piston that is rotatably arranged in the piston chamber and has a first face and a second face, wherein the first face of the rotary piston faces an interior of the first sidewall of the piston chamber and the second face of the rotary piston faces an interior of the second sidewall of the piston chamber;

at least two working zones formed between a peripheral surface of the rotary piston and the peripheral wall of the piston chamber;

at least one first lateral seal that is provided on the first and second faces of the rotary piston in order to seal intermediate spaces between the first and the second sidewall of the piston chamber and the first and second faces of the rotary piston relative to the working zones;

a central bore;

at least one second lateral seal that is provided on the first and the second face of the rotary piston in order to seal the respective intermediate spaces between the first and second sidewalls of the piston chamber and the first and second faces of the rotary piston relative to the central bore;

at least one ventilation bore provided only in one of the first and second sidewalls of the piston chamber and connected to at least one ventilation channel in the housing for discharging gases from the housing, wherein the at least one ventilation bore is arranged at a location that radially lies within the at least one first lateral seal and outside the at least one second lateral seal;

wherein the at least one second lateral seal is arranged radially within the at least one first lateral seal and wherein the at least one ventilation bore lies radially outside the at least one second lateral seal;

wherein the at least one ventilation bore lies within an angular segment; and wherein no other bore is provided in the first or second sidewall.

2. The rotary piston machine according to claim 1 further comprising, on its peripheral surface, at least one radial seal that protrudes in the direction toward the peripheral wall of the piston chamber, and wherein the at least one ventilation bore lies radially within the at least one radial seal.

3. The rotary piston machine according to claim 1, wherein the at least one ventilation bore lies within an angular segment of the cold arc of the piston chamber.

4. The rotary piston machine according to claim 1 further comprising at least one cavity that extends from the first face to the second face radially within the at least one first lateral seal or between the at least one first lateral seal and the at least one second lateral seal.

5. The rotary piston machine according to claim 1 further comprising, in the region of each working zone:

at least one first recess in the first face radially within the at least one first lateral seal or between the at least one first lateral seal and the at least one second lateral seal; and at least one second recess in the second face radially within the at least one first lateral seal or between the at least one first lateral seal and the at least one second lateral seal.

6. The rotary piston machine according to claim 1, wherein the at least one ventilation bore is connected to the ventilation channel via at least one connecting channel.

7. The rotary piston machine according to claim 1, wherein at least one of the ventilation bore and a connecting channel is at least partially realized in an ascending fashion in the direction toward the ventilation channel.

8. The rotary piston machine according to claim 1, further comprising at least one throttle or diaphragm configured to influence the respective opening cross section of the ventilation bore or a connecting channel provided in or on the at least one ventilation bore and/or the at least one connecting channel.

9. The rotary piston machine according to claim 1, wherein the ventilation bore has an elongated cross section in the concentric direction of the rotary piston.

10. The rotary piston machine according to claim 9, wherein the ventilation bore has an essentially reniform cross section.

11. The rotary piston machine according to claim 1, further comprising an additional connecting channel configured to connect the central bore of the rotary piston to the ventilation channel.

12. The rotary piston machine according to claim 11, wherein at least one of the ventilation channel, the connecting channel and the additional connecting channel comprises a labyrinth.

13. The rotary piston machine according to claim 11, wherein at least one of the ventilation channel, the connecting channel and the additional connecting channel comprises at least one plenum chamber.

14. The rotary piston machine according to claim 1, wherein the machine is suitable for use as a range extender for an electrically operated motor vehicle.

15. A power generating unit comprising a rotary piston machine, wherein the rotary machine comprises:

a housing;

a piston chamber that is defined in the housing by a first sidewall, a second sidewall and a peripheral wall interconnecting the first and second sidewalls;

a rotary piston that is rotatably arranged in the piston chamber and has a first face and a second face, wherein the first face of the rotary piston faces an interior of the first sidewall of the piston chamber and the second face of the rotary piston faces an interior of the second sidewall of the piston chamber;

at least two working zones formed between a peripheral surface of the rotary piston and the peripheral wall of the piston chamber;

at least one first lateral seal that is provided on the first and second faces of the rotary piston in order to seal intermediate spaces between the first and the second sidewall of the piston chamber and the first and second faces of the rotary piston relative to the working zones;

a central bore;

at least one second lateral seal that is provided on the first and the second face of the rotary piston in order to seal the respective intermediate spaces between the first and second sidewalls of the piston chamber and the first and second faces of the rotary piston relative to the central bore;

at least one ventilation bore provided only in one of the first and second sidewalls of the piston chamber and connected to at least one ventilation channel in the housing for discharging gases from the housing, wherein the at least one ventilation bore is arranged at a location that radially lies within the at least one first lateral seal and outside the at least one second lateral seal;

wherein the at least one second lateral seal is arranged radially within the at least one first lateral seal and wherein the at least one ventilation bore lies radially outside the at least one second lateral seal;

a rotatably supported shaft, on which the rotary piston revolves, provided in the housing and coupled to an electromechanical energy converter, wherein the at least one ventilation bore lies within an angular segment; and wherein no other bore is provided in the first or second sidewall.

* * * * *